US010342407B2

(12) United States Patent
Millett et al.

(10) Patent No.: US 10,342,407 B2
(45) Date of Patent: Jul. 9, 2019

(54) DOOR ASSEMBLY FOR A DISHWASHER

(71) Applicant: WHIRLPOOL CORPORATION, Benton Harbor, MI (US)

(72) Inventors: Frederick A. Millett, Grand Haven, MI (US); Daniel W. Southworth, South Bend, IN (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 985 days.

(21) Appl. No.: 14/799,819

(22) Filed: Jul. 15, 2015

(65) Prior Publication Data

US 2017/0014015 A1 Jan. 19, 2017

(51) Int. Cl.
*A47L 15/42* (2006.01)

(52) U.S. Cl.
CPC ..... *A47L 15/4263* (2013.01); *A47L 15/4257* (2013.01)

(58) Field of Classification Search
None
See application file for complete search history.

(56) References Cited

U.S. PATENT DOCUMENTS 3,168,089 A 2/1965 Larkin
3,170,456 A 2/1965 Moss et al.
3,389,522 A * 6/1968 Hordis ..... E06B 3/24 52/204.599
3,877,460 A * 4/1975 Lotz ..... F24C 15/04 126/198
3,925,947 A * 12/1975 Meyers ..... C03C 27/048 52/204.591
5,061,531 A 10/1991 Catalano
5,255,473 A 10/1993 Kaspar et al.
6,401,399 B1 6/2002 Roche et al.
6,817,144 B1 * 11/2004 Tavivian ..... A47K 3/30 4/607
7,265,323 B2 9/2007 Gerhardinger et al.
7,891,154 B2 2/2011 Cording
2010/0141103 A1 * 6/2010 Olesen ..... A47L 15/4257 312/228
2010/0210745 A1 * 8/2010 McDaniel ..... C09D 5/008 521/55
2012/0225993 A1 * 9/2012 Bernreitner ..... C08L 23/10 524/517
2013/0125939 A1 * 5/2013 Baldwin ..... A47L 15/4293 134/57 DL
2013/0214664 A1 8/2013 Yoon et al.

* cited by examiner

*Primary Examiner* — Jason Y Ko
*Assistant Examiner* — Cristi J Tate-Sims
(74) *Attorney, Agent, or Firm* — McGarry Bair PC

(57) ABSTRACT

A dishwasher includes a treating chamber for receiving dishes for treatment according to a cycle of operation and a door assembly selectively moveable to close an access opening to the treating chamber, the door assembly having an interior door panel, an exterior door panel, and a window assembly comprising first and second window panes supported within the door assembly by a peripheral frame.

22 Claims, 9 Drawing Sheets

DOOR ASSEMBLY FOR A DISHWASHER

BACKGROUND

A conventional automated dishwasher includes either a hinged or sliding door that selectively provides access to a treating chamber in which dishes are placed for treatment according to an automatic cycle of operation. Some doors may be provided with a window through which the treating chamber may be visible from an exterior of the dishwasher. The window provides an additional component in the dishwasher which must be provided within the dishwasher in such a manner as to minimize the leakage of fluid from the treating chamber to other parts of the dishwasher or to the exterior of the dishwasher.

BRIEF SUMMARY

An embodiment of the invention relates to a dishwasher comprising a treating chamber for receiving dishes for treatment according to a cycle of operation and a door assembly selectively moveable to close an access opening to the treating chamber, the door assembly comprising a door panel having a window opening, a spacer provided between confronting inner surfaces of first and second window panes, and a peripheral frame supporting the first and second window panes within the window opening.

DETAILED DESCRIPTION

Figure 1:
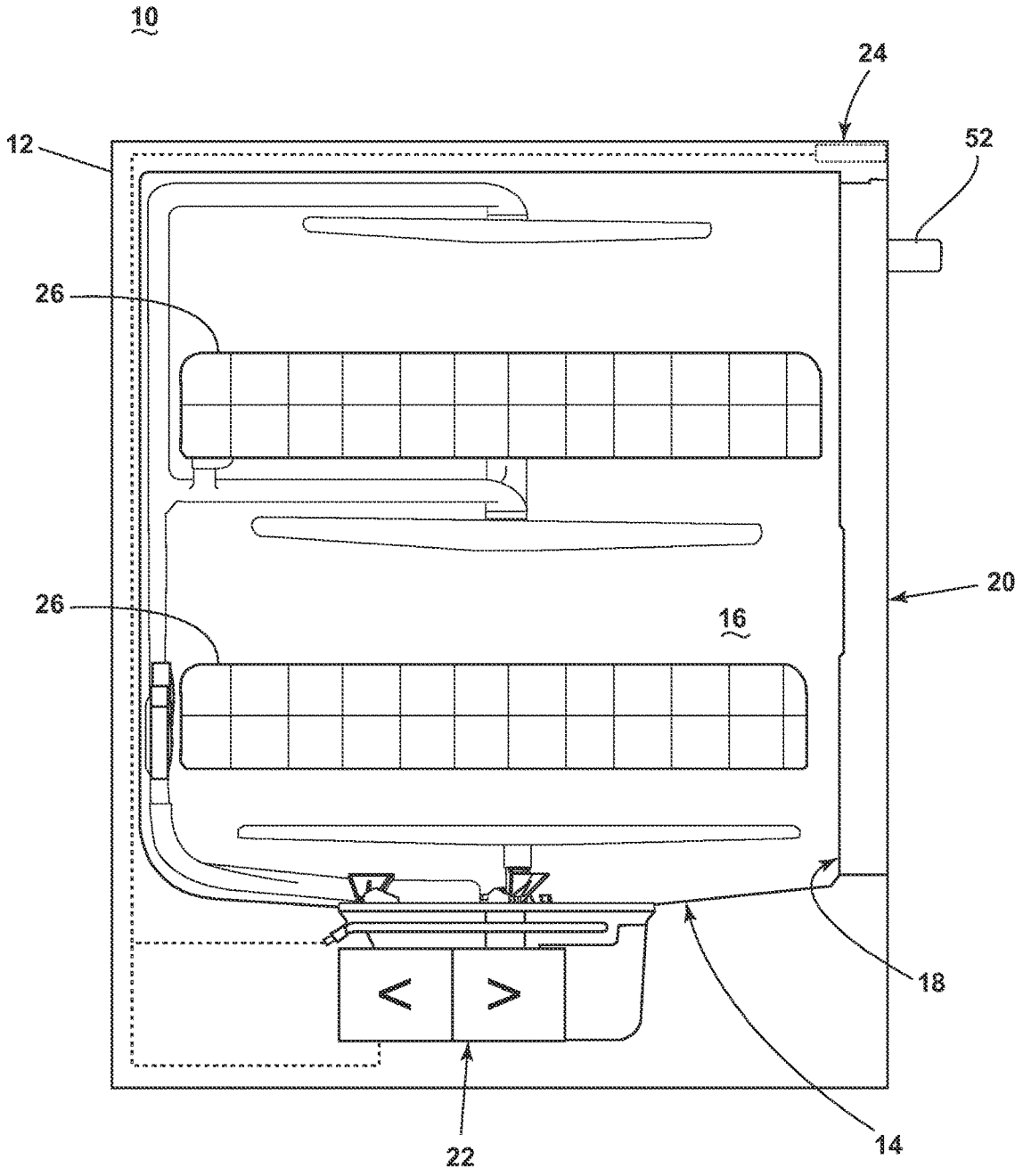
FIG. 1 is a schematic, cross-sectional view of a dishwasher according to an embodiment of the invention.

FIG. 1 is a schematic illustration of a dishwasher 10 that shares many features of a conventional automated dishwasher, which will not be described in detail herein except as necessary for a complete understanding of the invention. The dishwasher 10 may include a chassis 12 defining an interior of the dishwasher 10 and may include a frame, with or without panels mounted to the frame. A tub 14 may be provided within the chassis 12, and may at least partially define a treating chamber 16 for treating dishes according to a cycle of operation and further include an open face 18 defining an access opening to the treating chamber 16.

A door assembly 20 may be movably mounted to the dishwasher 10 for movement between opened and closed positions to selectively open and close the open face 18 of the tub 14. Thus, the door assembly 20 provides accessibility to the treating chamber 16 for the loading and unloading of dishes or other washable items. When the door assembly 20 is closed, user access to the treating chamber 16 may be prevented, whereas user access to the treating chamber 16 may be permitted when the door assembly 20 is open. The door assembly 20 may be hingedly connected with the chassis 12 or slidingly attached to a drawer slide system to selectively provide access to the treating chamber 16.

Additional features, such as a liquid supply and circulation system 22, including one or more liquid supply and drain conduits, sprayers and/or pumps, a control system 24 including one or more controllers and a user interface, one or more dish racks 26, and any other alternative or additional features used in a conventional automatic dishwasher may also be provided in the dishwasher 10 without deviating from the scope of the invention.

Figure 2:
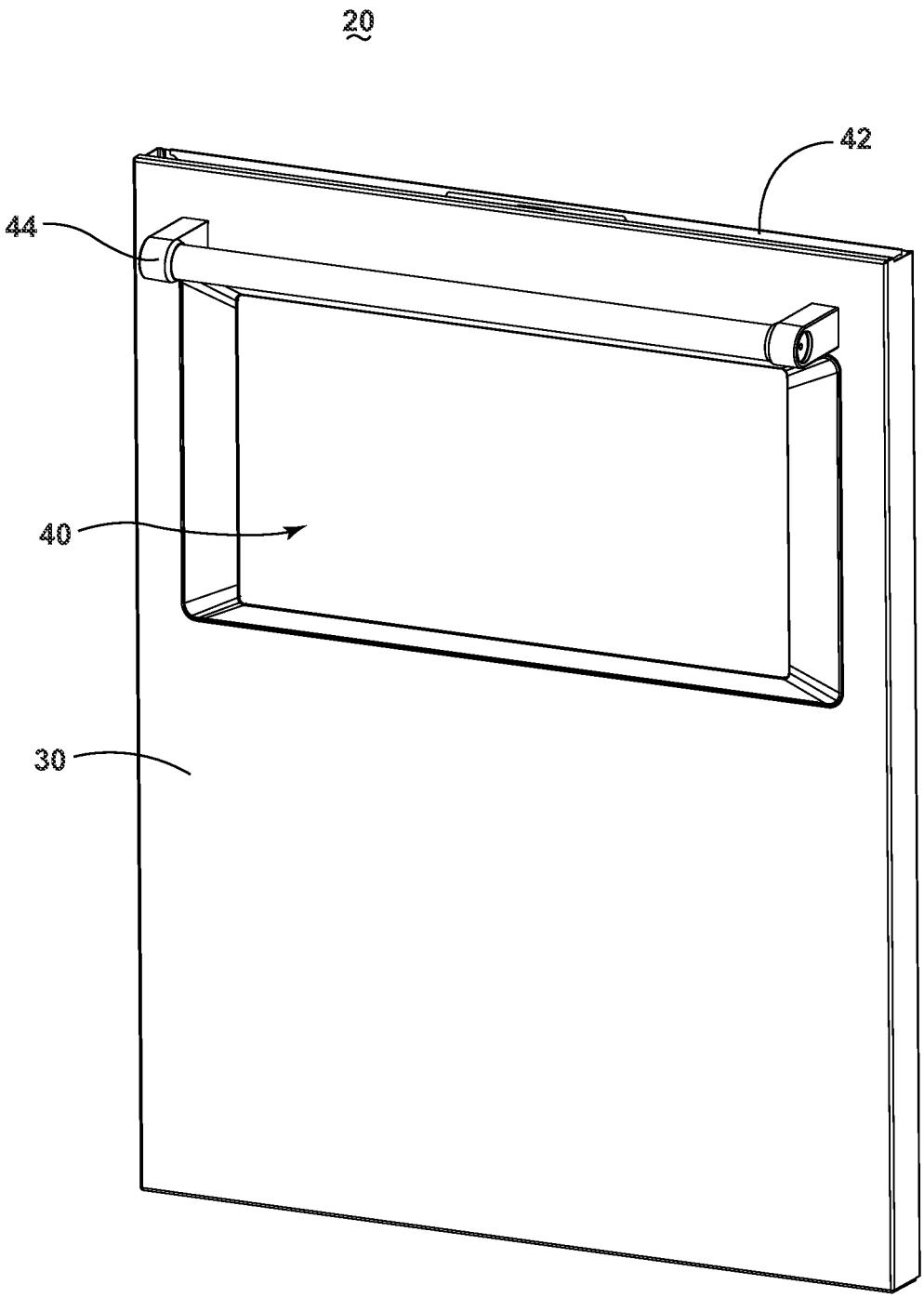
FIG. 2 is a front perspective view of a door assembly for a dishwasher according to an embodiment of the invention.

Referring now to FIG. 2, the door assembly 20 may include an exterior door panel 30, a window assembly 40, and an interior door panel 42 which faces the treating chamber 16 of the dishwasher 10 when the door assembly 20 is in the closed position. The exterior door panel 30 may be coupled with the interior door panel 42 to collectively form a door using any suitable mechanical and/or non-mechanical fasteners, non-limiting examples of which include screws, pins, clips, welds and adhesives. It is also within the scope of the invention for the door to be in the form of a single piece door that does not include separate interior and exterior panels. The door assembly 20 may include additional features, such as a handle or grip 44, a treating chemistry dispenser, and/or a user interface, the details of which are not germane to the embodiments of the invention. The window assembly 40 may provide a user with a view of at least a portion of the treating chamber 16 from an exterior of the dishwasher 10.

Figure 3A:
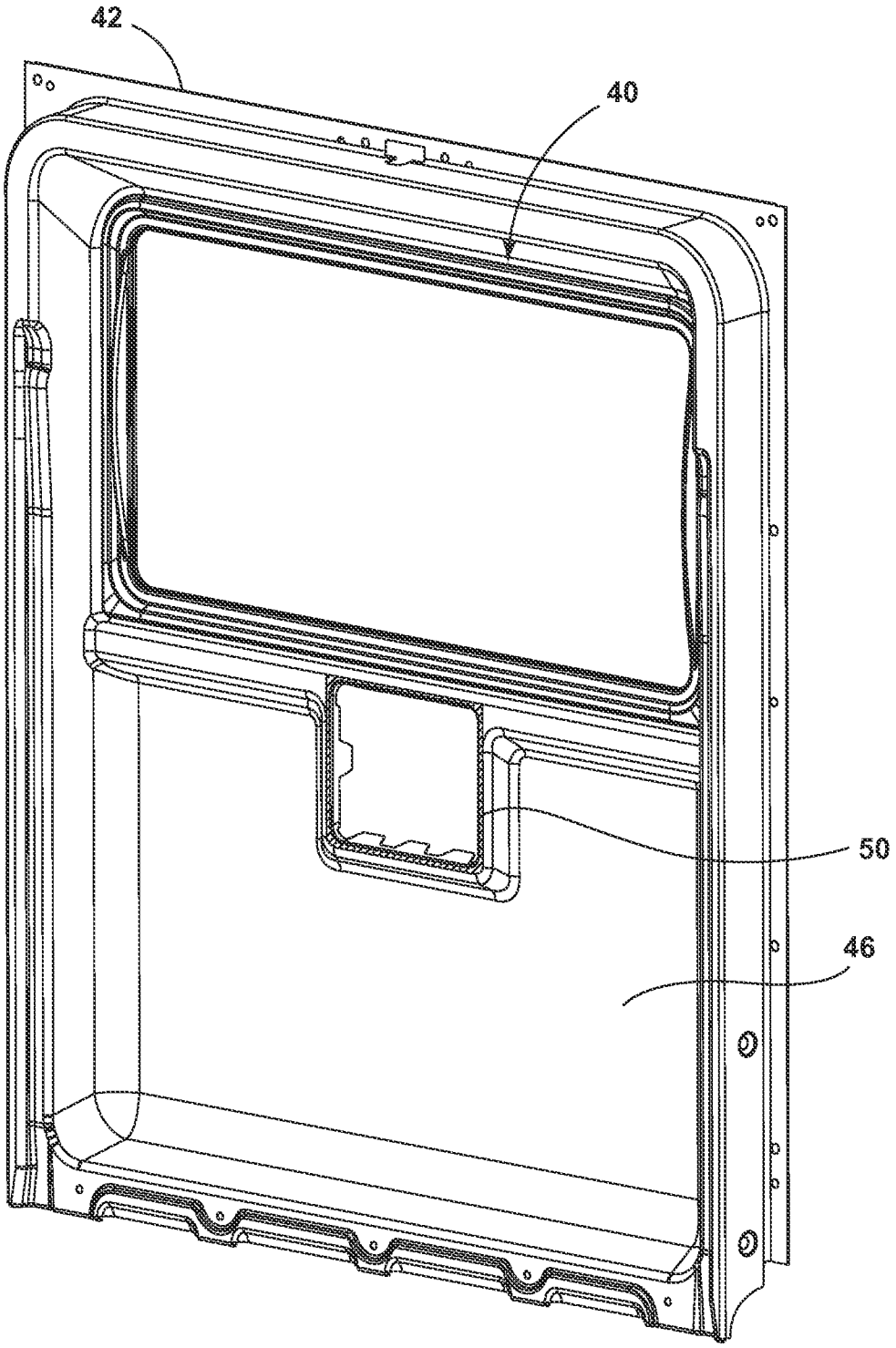
FIG. 3A is a rear perspective view of an interior side of the inner door panel assembly of the door assembly of FIG. 2 according to an embodiment of the invention.
Figure 3B:
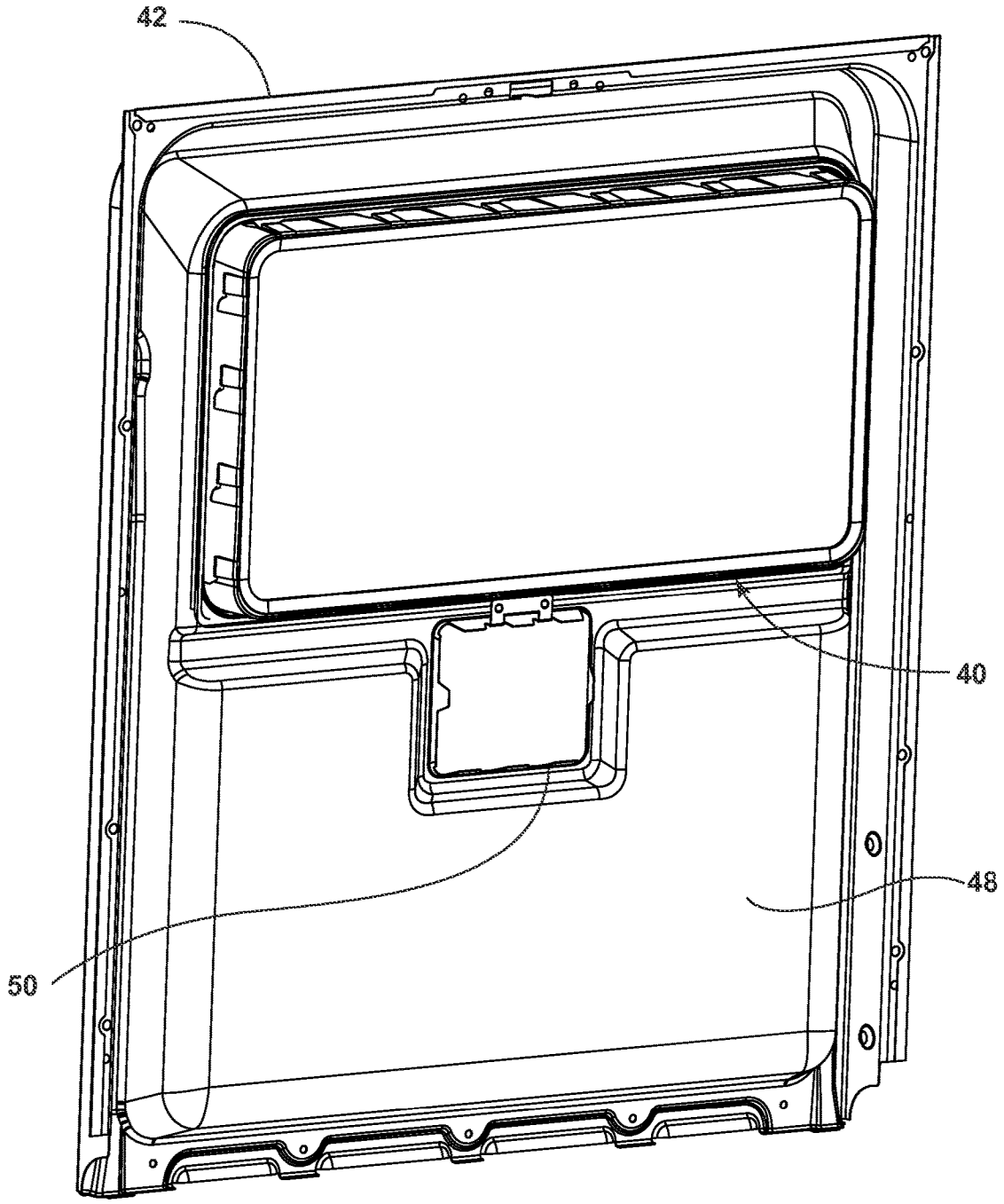
FIG. 3B is a front perspective view of an exterior side of the inner door panel assembly of the door assembly of FIG. 2 according to an embodiment of the invention.

FIGS. 3A and 3B illustrate an inner face 46 and an outer face 48 of the interior door panel 42 having the window assembly 40 mounted therein forming an interior door panel assembly. The inner face 46 of the interior door panel 42 faces the treating chamber 16 of the dishwasher 10 while the outer face 48 faces away from the treating chamber 16 towards the exterior of the dishwasher 10 and is adjacent an inner face of the exterior door panel 30. The interior door panel 42 can optional be provided with an aperture 50 for supporting a dispenser, as is known in the art.

Figure 4:
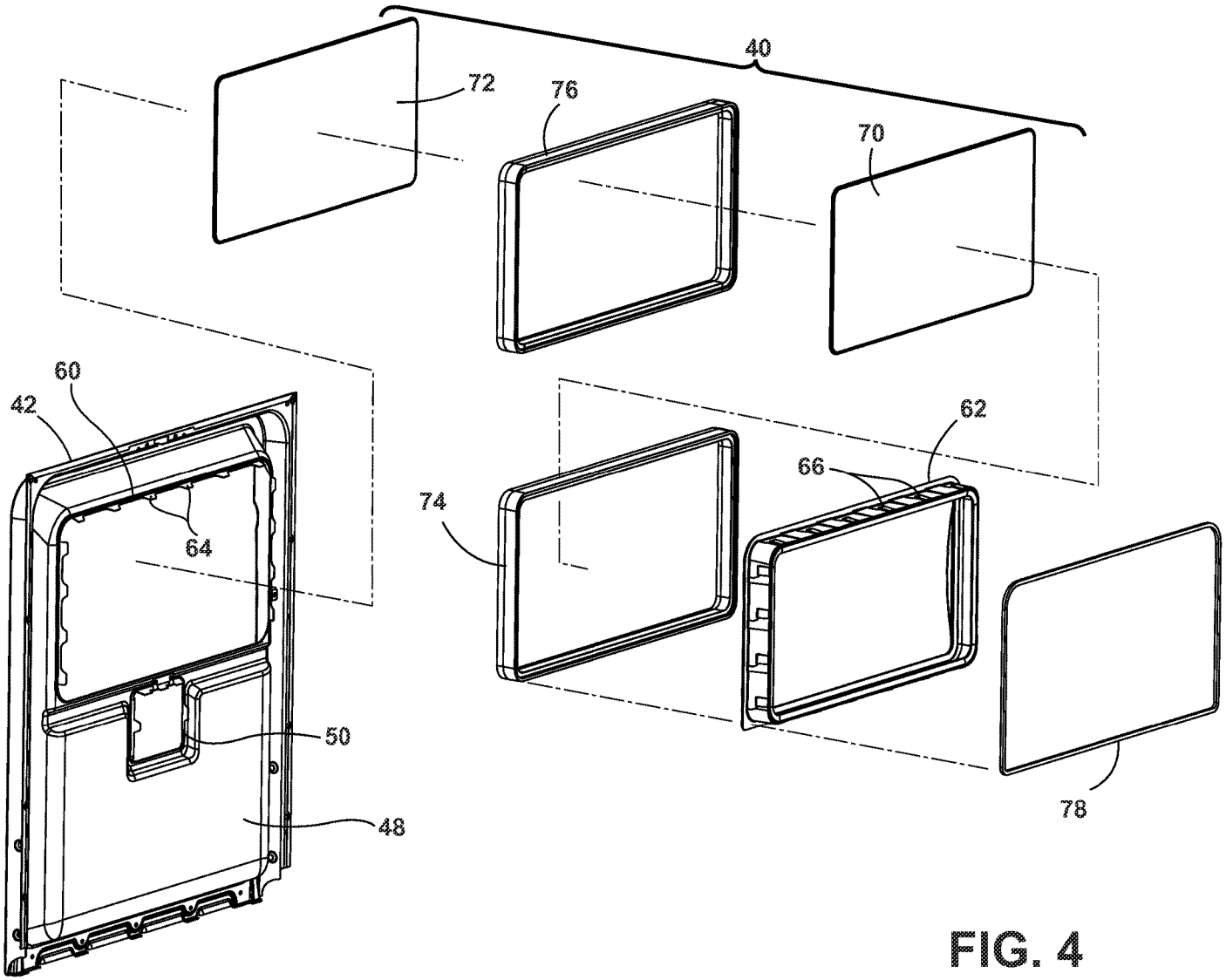
FIG. 4 is an exploded view of the inner door panel assembly of FIGS. 3A-3B according to an embodiment of the invention.

Referring now to FIG. 4, the interior door panel 42 includes an interior window opening 60. The window assembly 40 can include a peripheral frame 62 to support the window assembly 40 in at least partial alignment with the interior window opening 60. The interior door panel 42 may include a plurality of mounting flanges 64 defining the interior window opening 60 which engage aligned detents 66 for engaging the peripheral frame 62 to support the peripheral frame 62 within the interior window opening 60. The mounting flanges 64 may be resilient flanges that flex outward as the peripheral frame 62 is inserted through the interior window opening 60 and the mounting flanges 64 engage the detents 66 and then return to their un-flexed position to engage the peripheral frame 62 when the detents 66 pass a terminal edge of the mounting flanges 64. Alternatively, or additionally, the mounting flanges 64 may be in the form of flanges having apertures for receiving fasteners that are inserted into aligned apertures in the peripheral frame 62.

Figure 5:
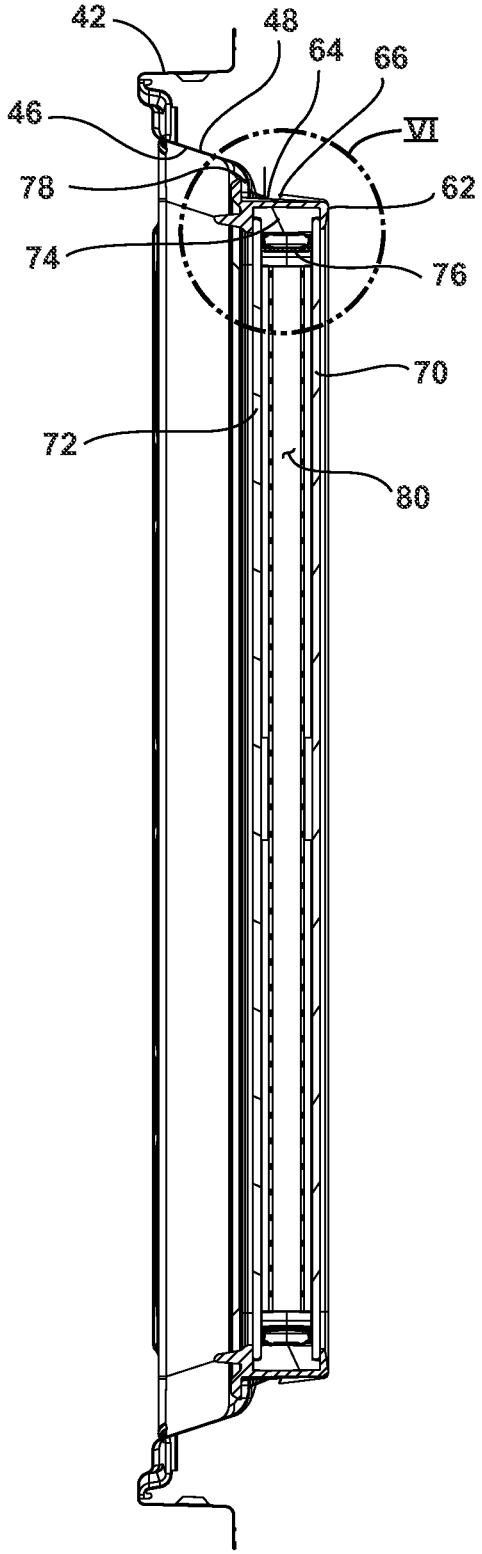
FIG. 5 is a cross-sectional view of the inner door panel assembly of FIGS. 3A-3B according to an embodiment of the invention.

Referring now to FIG. 5, the window assembly 40 may include a first or exterior window pane 70, a second or interior window pane 72, a spacer 74, an edge seal element 76, and an optional seal 78 provided between the inner face 46 of the interior door panel 42 and the peripheral frame 62. The first and second window panes 70, 72 may be made from a material that is at least partially transparent such that light may travel through the window assembly 40 from the treating chamber 16 to an exterior of the dishwasher 10 such that a user may view at least a portion of the treating chamber 16 from the exterior of the dishwasher. The first and second window panes 70, 72 can be made from glass, tempered glass, borosilicate glass, or ceramic glass or transparent plastics, such as acrylic, polycarbonate, nylon, or acrylonitrile-butadiene-styrene (ABS). In another example, the first and/or second window panes 70, 72 may be made from materials having light transmission properties that change when voltage, light or heat is applied. Non-limiting examples of such materials include electrochromic, photochromic, and thermochromic materials. In one example, the first and/or second window panels 70, 72 may be made from a polymer dispersed liquid crystal device in which the light transmission properties may be changed by modifying the voltage applied to the material.

Figure 6:
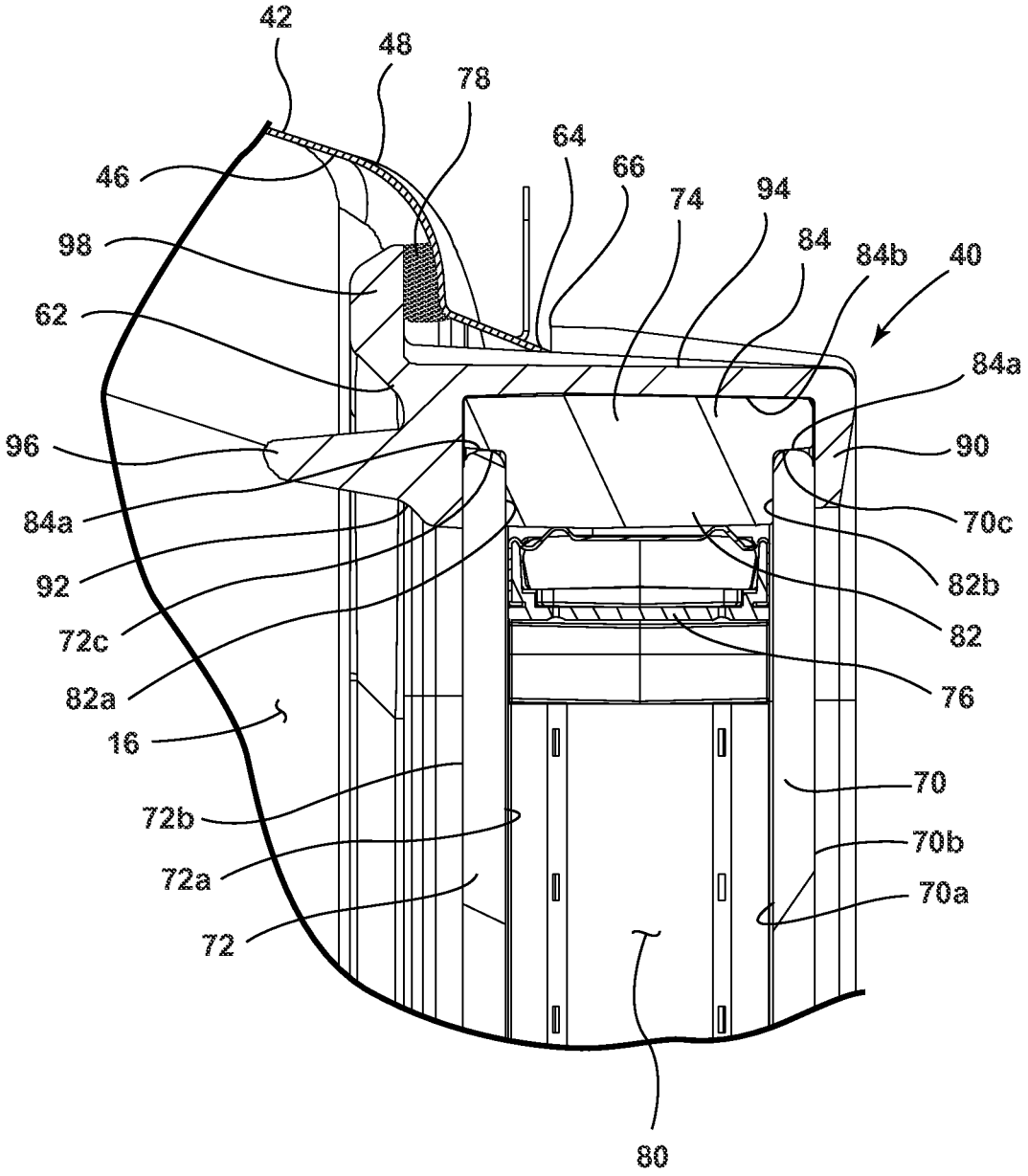
FIG. 6 is a cross-sectional view of a portion of the inner door panel assembly indicated in FIG. 5 according to an embodiment of the invention.

Referring now to FIG. 6, each window pane 70, 72 includes an inner surface 70*a*, 72*a*, and outer surface 70*b*, 72*b*, and a peripheral edge 70*c*, 72*c*, with the inner surfaces 70*a*, 72*a* in a confronting relationship. The spacer 74 is provided between the confronting inner surfaces 70*a*, 72*a* and along the peripheral edges 70*c*, 72*c* of the window panes 70, 72 to maintain the exterior and interior window panes 70, 72 in a spaced relationship and define a chamber 80 therein. The spacer 74 can have a generally "T-shaped" cross-section having a body 82 intersecting with a head 84. The body 82 of the spacer 74 has a first, inner face 82*a* adjacent the inner surface 72*a* of the interior window pane 72 and a second, outer or exterior face 82*b* adjacent the inner surface 70*a* of the exterior window pane 70. The head of the spacer 74 can have an inner face 84*a* adjacent the peripheral edge 70*c*, 72*c* of the exterior and interior window panes 70, 72.

The peripheral frame 62 has a generally "C-shaped" interior cross-section that receives the spacer 74, the peripheral edge 70*c*, 72*c*, and at least a portion of the outer surface 70*b*, 72*b* of the exterior and interior window panes 70, 72 adjacent the spacer 74 and peripheral edges 70*c*, 72*c* and extends about the perimeter of the spacer 74 and peripheral edges 70*c*, 72*c*. The peripheral frame 62 can include opposing exterior and interior legs 90 and 92, respectively, connected by a horizontal leg 94. The exterior leg 90 can be in the form of a trim bezel. The interior leg 92 can include an inwardly extending flange 96 extending about at least a portion of the perimeter of the peripheral frame 62. The peripheral frame 62 can further include a depending leg 98 extending away from the "C-shaped" portion of the peripheral frame 62 adjacent the inner face 46 of the interior door panel 42 and configured to seal with the interior door panel 42 through the seal 78, which can be in the form of a sealant and/or a gasket.

Still referring to FIG. 6, the edge seal element 76 is provided between the confronting inner surfaces 70*a*, 72*a* of the window panes 70, 72 adjacent the spacer body 82 and extend about the perimeter of the spacer 74. The edge seal element can be in the form of any suitable edge seal element providing a desiccant material, air gaps, and/or gas filled areas. Non-limiting examples of suitable edge seal elements include a hollow spacer frame filled with desiccant beads or an insulating glass edge spacer system, such as Duralite® or Duraseal®, available from Quanex, U.S.A., which provide a desiccant and vapor barrier seal.

Figure 7:
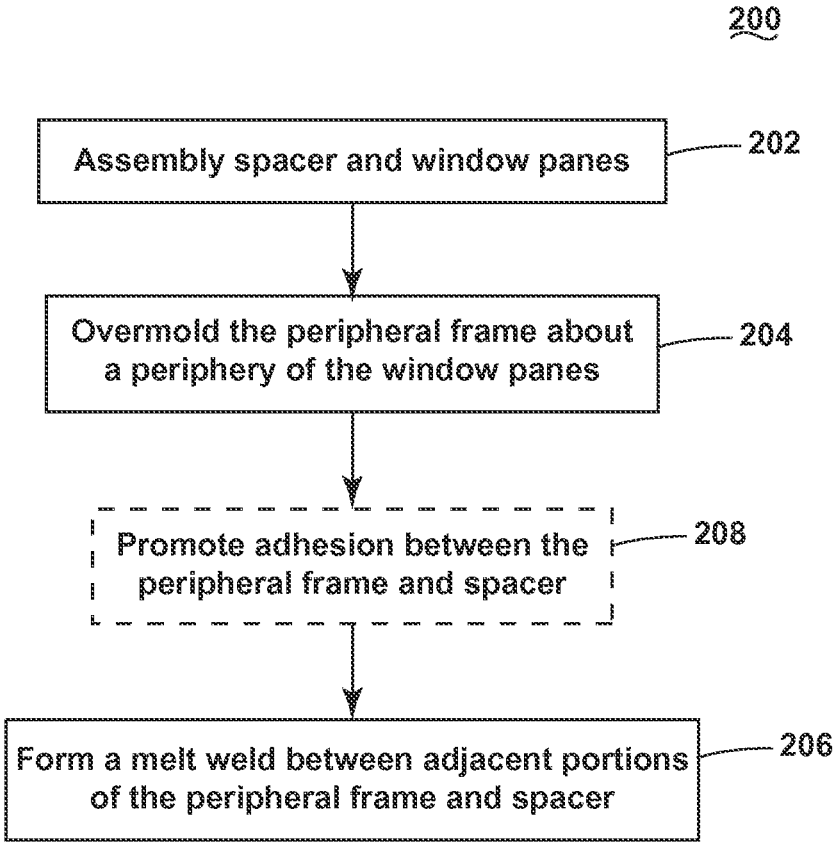
FIG. 7 is a flow chart of a process for forming a window assembly for use with the door assembly of FIG. 2 according to an embodiment of the invention.

FIG. 7 illustrates an exemplary process 200 for assembling any of the window assemblies described herein and will be described in the context of the window assembly 40. The process 200 can be used to form a leak-proof or leak resistant seal between the peripheral frame 62 and the spacer 74 and interior and exterior window panes 70, 72. The sequence of steps depicted for this method and the proceeding methods are for illustrative purposes only, and is not meant to limit any of the methods in any way as it is understood that the steps may proceed in a different logical order or additional or intervening steps may be included without detracting from the invention.

The process 200 begins with assembling the spacer 74 and the edge seal element 76 between the confronting inner surfaces 70*a*, 72*a* of the exterior and interior window frames 70, 72 at 202. Assembling the spacer 74 and edge seal element 76 with the exterior and interior window frames 70, 72 can include the application of one or more sealants between the components. For example, a sealant can be provided between the spacer 74 and the edge seal element 76 and/or between the inner surfaces 70*a*, 72*a* and the spacer 74 and/or the edge seal element 76. Non-limiting examples of suitable types of sealants include silicone, a butyl rubber based sealant, a polyisobutylene sealant, and combinations thereof.

At 204, the peripheral frame 62 can be overmolded about the periphery of the assembled spacer 74 and peripheral edges 70*c*, 72*c* of the exterior and interior window panes 70, 72 in an injection molding process to encapsulate the assembled window panes 70, 72 and spacer 74. During the injection molding process, the spacer 74 provides support to the exterior and interior window panes 70, 72 to prevent the window panes 70, 72 from being damaged due to the molding pressure. The material forming the spacer 74 as well as the dimensions of the spacer 74 can be configured to provide sufficient support for the window panes 70, 72 during the injection molding process. In addition, the location and number of gates, i.e. the openings through which the molten polymeric material is injected into the mold cavity, can be selected to maintain the pressure on the window panes 70, 72 during the injection molding process below the yield point of the spacer 74. As used herein, yield point refers to the point at which plastic deformation begins in the stress-strain curve for the materials used to form the spacer 74. For example, gates can be provided at or adjacent the corners of the peripheral frame 62 and/or near the thickest portion of the peripheral frame 62, which in the embodiment of FIG. 6 is in the area of the interior leg 92 flange 96.

At 206 at least a partial melt weld (also referred to as a melt bond, fusion weld, or fusion bond) can be formed between adjacent portions of the peripheral frame 62 and the spacer 74 around at least a portion of the periphery of the peripheral frame 62 and the spacer 74 to form a seal about the peripheral edges 70*c*, 72*c* of the window panes 70, 72. The materials forming the peripheral frame 62 and the spacer 74 can be selected such that a bond is formed between adjacent portions of the peripheral frame 62 and the spacer 74 during the overmolding process at 204. The bond between the peripheral frame 62 and the spacer 74 can be formed in a melt or fusion welding process in which a molecular bond is generated between two compatible thermoplastic materials when heat is used to melt or soften the polymer at the interface to enable polymer intermolecular diffusion across the interface and polymer chain entanglements to form a melt weld.

To facilitate the formation of at least a partial melt weld between the adjacent portions of the peripheral frame 62 and the spacer 74, the materials forming the peripheral frame 62 and the spacer 74 include a compatible base polymeric resin which may be the same or different. Several factors can affect the degree of welding between the materials forming the peripheral frame 62 and the spacer 74, non-limiting examples of which include the polymer structure, melt temperature, melt index (flow), and modulus of elasticity (stiffness) of the base resin. Generally, compatible materials will have a melt temperature difference within about 22° C. of each other and/or similar molecular groups. Additional parameters that can affect the degree of welding include interfacial pressure, time, and the degree of interfacial contact between the materials forming the bond.

In a preferred embodiment, the peripheral frame 62 and the spacer 74 are made from the same base resin, preferably a polypropylene-based resin. When both the peripheral frame 62 and the spacer 74 are made from a polypropylene-based resin, the amount of force required to separate the peripheral frame 62 and the spacer 74 is greater than the amount of force required when the peripheral frame 62 is made from a nylon-based material and the spacer 74 is made from a polypropylene-based material. In one example, the amount of force required to separate the peripheral frame is made from a nylon-based material and a spacer made from a polypropylene-based material was such that the peripheral frame and spacer could be separated by hand, whereas when the peripheral frame and spacer were both made from a polypropylene-based material which were at least partially melt welded, the amount of force required to separate the peripheral frame and spacer was on the order of 600-1000 lbs. The increase in separation force can provide an indication of the strength of the seal between the peripheral frame and spacer.

In the preferred embodiment, one or both of the peripheral frame 62 and the spacer 74 are made from a material that includes a polypropylene-based resin and one more additives, including a filler. The filler can be used to increase the strength of the peripheral frame 62 and the spacer 74, which may be the same or different in the peripheral frame 62 and the spacer 74. During the overmolding process of 204, the spacer 74 must be configured to support the exterior and interior window panes 70, 72 and withstand the pressure applied by the injected polymeric melt. However, increasing amounts of filler can decrease the degree of welding between materials. Thus, the amount of filler present in the spacer 74 can be selected so as to balance the requirements of strength necessary to withstand the molding pressures and provide a bond between the peripheral frame 62 and the spacer 74 having the desired strength. In an exemplary embodiment, the peripheral frame 62 is made from a material including a polypropylene-based resin and having about 10-50% by weight (wt. %) filler and the spacer 74 is made from a material including a polypropylene-based resin and having a filler loading of about 10-50 wt. %. In one example, the peripheral frame 62 includes a 20 wt. % filler loading and the spacer 74 includes a 30 wt. % filler loading. Non-limiting examples of suitable fillers include fiberglass, minerals, glass, mica, calcium carbonate, sand, quartz, carbon black, nanotubes, glass spheres, and talc.

The base resin for the peripheral frame 62 and the spacer 74 are also preferably selected to be compatible with the environment inside the dishwasher treating chamber 16. During a cycle of operation, the components of the dishwasher 10 in fluid contact with the treating chamber 16 can be exposed to a variety of treating agents and debris and variations in temperature and moisture. Polypropylene-based resins have been found to be satisfactorily compatible with the conditions inside the treating chamber 16. Alternative resins, such as polyvinylchloride, while they may exhibit acceptable bond strength between the peripheral frame 62 and the spacer 74 when used in forming the peripheral frame 62 and the spacer 74, are generally not satisfactorily compatible with the conditions inside the treating chamber 16. For example, polyvinylchloride can be damaged by repeated exposure to detergent, in some cases.

The base resin for the peripheral frame 62 and the spacer 74 can also be selected to have similar coefficients of thermal expansion. In use in the dishwasher 10, during a cycle of operation, the components exposed to the treating chamber 16 will experience variations in temperature and moisture during the cycle of operation. If the coefficient of thermal expansion of the materials used in the peripheral frame 62 and spacer 74 are too dissimilar, stress may be applied to the bonds between the peripheral frame 62 and spacer 74, potentially weakening the seal formed around the window panes 70, 72. In a preferred embodiment, the material used to form peripheral frame 62 has a coefficient of thermal expansion within 10% or less, preferably 5% or less, of the coefficient of thermal expansion of the material used to form the spacer 74. The amount of filler used in either or both the materials used to form the peripheral frame 62 and the spacer 74 can be used up to a loading level of about 50 wt. % to facilitate the adjusting the coefficient of thermal expansion for each material to a value that is within 10% and/or that is compatible with the environment within the dishwasher 10 during a cycle of operation.

The process 200 can also include an optional additional step to promote adhesion between the peripheral frame 62 and the spacer 74 at 208. In one example, at least the outer face of the head 84*b* of the spacer 74 can be provided with an adhesion promoter to facilitate the formation of a melt weld between adjacent faces of the peripheral frame 62 and the spacer 74. Non-limiting examples of an adhesion promoter includes Primer 94, available from 3M™, Loctite® 793™ Prism® Primer, available from Henkel. Alternatively, or additionally, the outer face of the head 84*b* can be treated to provide a texture or grain to the spacer 74. Non-limiting examples of treatments to add texture or grain include vapor honing, in which the outer face of the head 84*b* is subjected to a vapor to disrupt the surface, a chemical etching process, such as acid etching, dry or wet abrasive blasting, or a chemical mold etching process. In an exemplary embodiment, the spacer 74 can be provided with a surface roughness in the range of 0.1-0.3 micrometers.

The encapsulation of the window assembly 40 by the peripheral frame 62 and the formation of at least a partial melt weld between adjacent portions of the peripheral frame 62 and the spacer 74 is provided to form a seal about the peripheral edges 70*c*, 72*c* of the exterior and interior window panes 70, 72 to seal the chamber 80 from the exterior environment, particularly the environment within the treating chamber 16. During the overmolding process 204, the molten polymeric resin molds around the portions of the outer surfaces 70*b*, 72*b* and peripheral edges 70*c*, 72*c* of the exterior and interior window panes 70, 72 adjacent the bezel 90 and interior leg 92 and forms a mechanical bond between these adjacent components as the polymeric resin shrinks and cools. The melt weld between adjacent portions of the peripheral frame 62 and the spacer 74 provides an additional seal around the peripheral edges 70*c*, 72*c* of the exterior and interior window panes 70, 72.

During use of the dishwasher 10, water, treating chemistry, and debris can come into contact with any of the components of the dishwasher 10 in fluid communication with the treating chamber 16. If the window assembly 40 is not adequately sealed, liquid, and any materials carried by the liquid, such as food debris, can leak into the chamber 80 between the exterior and interior window panes 70, 72, and form an undesirable film or sludge within the chamber 80 over time, which may become visible to the consumer. Even if the liquid evaporates within the chamber 80, debris, such as food debris or dissolved salts carried by the liquid, will remain and can build up over time. In some cases, the liquid may even leak to an exterior of the dishwasher 10. The encapsulation of the window assembly 40 by the peripheral frame 62 and the formation of at least a partial melt weld between adjacent portions of the peripheral frame 62 and the spacer 74 is provided to form a seal about the peripheral edges 70*c*, 72*c* of the exterior and interior window panes 70, 72 to inhibit leakage around and into the window assembly 40.

Figure 8:
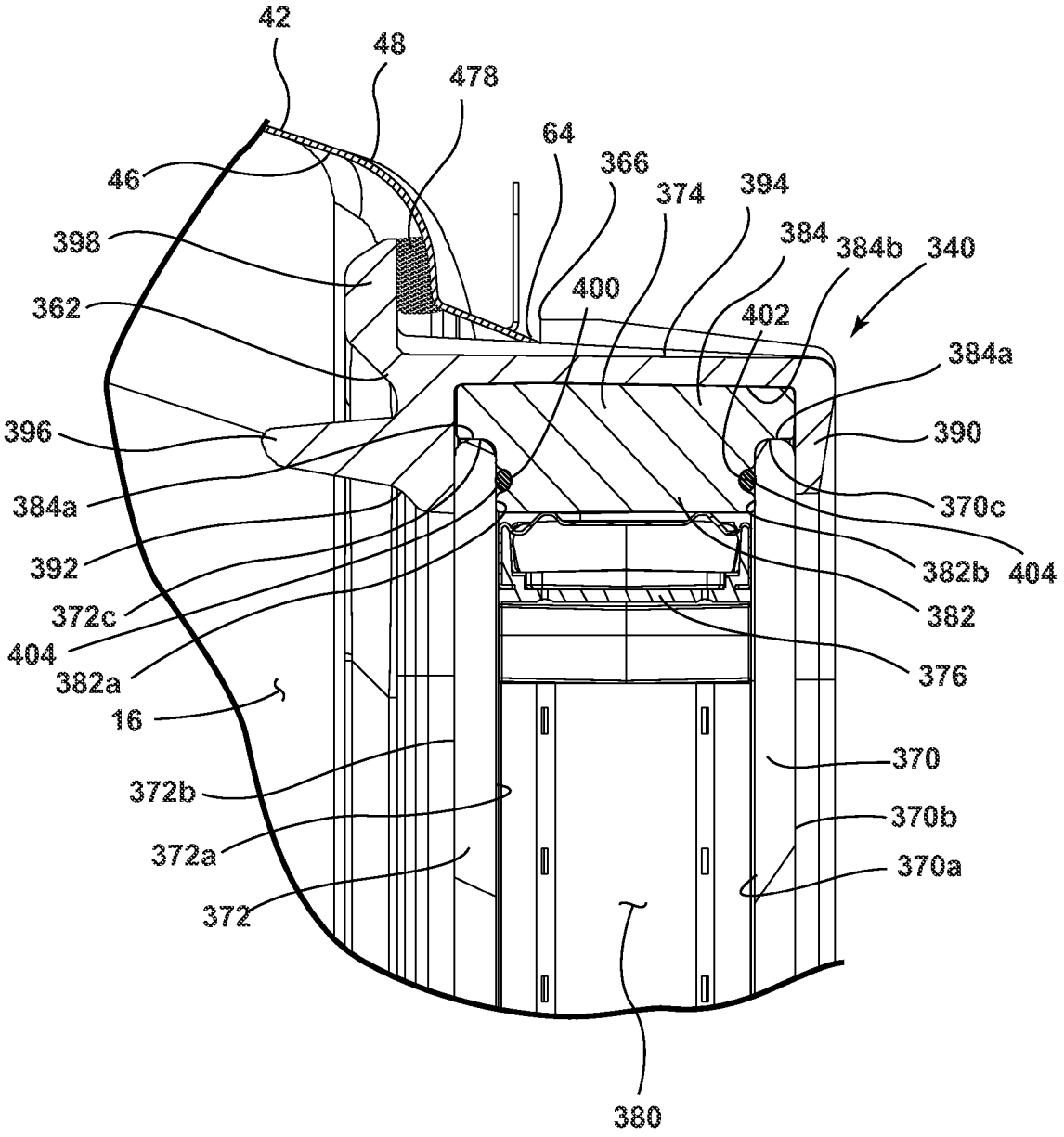
FIG. 8 is a cross-sectional view of a portion of an inner door panel assembly according to an embodiment of the invention.

FIG. 8 illustrates window assembly 340 that is similar to the window assembly 40 of FIG. 6 except for the configuration of the spacer 374. Therefore, elements of the window assembly 340 similar to those of the window assembly 40 are labeled with the prefix 300. The window assembly 340 can be used with the interior door panel 42 in a manner similar to that described above with respect to the window assembly 40.

Still referring to FIG. 8, the spacer 374 includes a first channel 400 provided in the inner face of the body 382*a* where the interior window pane 372 overlaps with the body 382 of the spacer 374. The channel 400 can extend about a perimeter of the body 382 of the spacer 372 in the inner face 382*a*. Additionally, as illustrated, or alternatively, a second channel 402 can be provided in the outer face of the body 382*b* where the exterior window pane 370 overlaps with the body 382 of the spacer 374. The channels 400, 402 can be configured to receive a sealing element 404 to form a seal between the body 382 of the spacer 374 and the adjacent inner surfaces 370*a*, 372*a* of the exterior and interior window panes 370, 372. The sealing element 404 can be any suitable sealant, gasket, or combinations thereof, non-limiting examples of which include silicone, a butyl rubber based sealant, a polyisobutylene sealant, and silicone or rubber-based gasket. The sealing element 404 can provide a seal between the spacer 372 and the inner surfaces 370*a*, 372*a* of the exterior and interior window panes 370, 372 to seal the chamber 380 to inhibit leakage of liquid from within the treating chamber 16 into and around the window assembly 340.

The window assembly 340 can be encapsulated by the peripheral frame 362 in a manner similar to that described above for the window assembly 40 and peripheral frame 62 according to the process 200 of FIG. 7. Additionally, or alternatively, a partial melt weld can be formed between the adjacent portions of the peripheral frame 362 and the spacer 374 in a manner similar to that described above the peripheral frame 62 and spacer 74 according to the process 200 of FIG. 7.

The door assembly 20 described herein includes a window assembly 40, 340 formed with first and second window panes that define an intervening sealed chamber. In a traditional door assembly in which two separate panels are individually attached, one to the exterior door panel and the other to the interior door panel, humidity and condensation may occur between the panels, which is difficult to prevent. The window assemblies 40, 340 described herein form a sealed chamber that minimizes the likelihood of moisture and debris entering the space between the first and second window panes that could obscure the view through the window assemblies 40, 340 or build-up over time.

To the extent not already described, the different features and structures of the various embodiments of the invention may be used in combination with each other as desired. For example, one or more of the features illustrated and/or described with respect to one of the window assemblies 40, 340 may be used with or combined with one or more features illustrated and/or described with respect to the other of the window assemblies 40, 340. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A door assembly for a dishwasher comprising a treating chamber for receiving dishes for treatment according to a cycle of operation, the door assembly selectively moveable to close an access opening to the treating chamber, the door assembly comprising:

a door panel adjacent the treating chamber and having a window opening;

first and second window panes each having an inner surface, an outer surface, and a peripheral edge, with the inner surfaces being in an overlying and confronting relationship;

a spacer made from a first polymeric material provided between the confronting inner surfaces along the peripheral edges to maintain the first and second window panes in a spaced relationship and defining a chamber there between; and a peripheral frame made from a second polymeric material provided on the door panel and supporting the first and second window panes within the window opening, the peripheral frame extending around the peripheral edges and directly adjacent to and contacting the spacer;

wherein the peripheral frame is sealed directly with an exterior surface of the spacer around at least a portion of the peripheral edges by a melt weld between the first polymeric material and the second polymeric material to form a mechanical bond between the first polymeric material and the second polymeric material and to at least partially encapsulate the peripheral edges to form a sealed chamber between the first and second window panes.

2. The door assembly according to claim 1 wherein the first polymeric material and the second polymeric material have coefficients of thermal expansion that are the same or within 10%.

3. The door assembly according to claim 1 wherein the first polymeric material comprises a first base resin and the second polymeric material comprises a second base resin that is the same as the first base resin.

4. The door assembly according to claim 3 wherein the first and second base resins comprise polypropylene.

5. The door assembly according to claim 1 wherein the first polymeric material comprises a first filler and the second polymeric material comprises a second filler.

6. The door assembly according to claim 5 wherein the first and second fillers are the same.

7. The door assembly according to claim 5 wherein the first filler comprises 10-50 wt. % of the first polymeric material.

8. The door assembly according to claim 5 wherein the second filler comprises 10-50 wt. % of the second polymeric material.

9. The door assembly according to claim 5 wherein the first and second fillers comprise fiberglass, minerals, glass, mica, calcium carbonate, sand, quartz, carbon black, nanotubes, glass spheres, or talc.

10. The door assembly according to claim 1 wherein the peripheral frame is overmolded onto the spacer in an injection molding process.

11. The door assembly according to claim 1 wherein the peripheral frame comprises an encapsulation of at least a portion of the outer surface of the window pane adjacent the treating chamber, at least a portion of the outer surface of the window pane opposite the treating chamber, the peripheral edges about an entire periphery of the window panes, or a combination thereof by the melt weld.

12. The door assembly according to claim 1 wherein the exterior surface of the spacer comprises an adhesion promotor to facilitate melt welding of the peripheral frame with the exterior surface of the spacer.

13. The door assembly according to claim 1 wherein the exterior surface of the spacer comprises a grain to facilitate melt welding of the peripheral frame with the exterior surface of the spacer.

14. The door assembly according to claim 13 wherein the grain is formed by a vapor honing process, an abrasive blasting process, a chemical mold etching process, or a chemical etching process.

15. A door assembly for a dishwasher comprising a treating chamber for receiving dishes for treatment according to a cycle of operation, the door assembly selectively moveable to close an access opening to the treating chamber, the door assembly comprising:

a door panel adjacent the treating chamber and having a window opening;

first and second window panes each having an inner surface, an outer surface, and a peripheral edge, with the inner surfaces being in an overlying and confronting relationship;

a spacer provided between the confronting inner surfaces along the peripheral edges to maintain the first and second window panes in a spaced relationship and defining a chamber there between, the spacer having a first side adjacent the inner surface of the first window pane and a second side adjacent the inner surface of the second window pane;

a channel provided in and extending about a perimeter of at least one of the first or second sides of the spacer;

a sealing element provided in the channel; and a peripheral frame provided on the door panel and supporting the first and second window panes within the window opening, the peripheral frame extending around the peripheral edges and directly adjacent to and contacting the spacer;

wherein the sealing element forms a seal with the inner surface of the adjacent one of the first and second window panes to form a sealed chamber between the first and second window panes.

16. The door assembly according to claim 15 wherein the channel extends about the perimeter of the first and second sides of the spacer.

17. The door assembly according to claim 15 wherein the spacer is melt-welded with the peripheral frame about at least a portion of its perimeter.

18. The door assembly according to claim 17 wherein the peripheral frame comprises an encapsulation of at least a portion of the outer surface of the window pane adjacent the treating chamber, at least a portion of the outer surface of the window pane opposite the treating chamber, the peripheral edges about an entire periphery of the window panes, or a combination thereof by the melt weld.

19. The door assembly according to claim 15 wherein the peripheral frame is overmolded onto the spacer in an injection molding process.

20. The door assembly according to claim 15 wherein the sealing element comprises silicone, a butyl rubber based sealant, a polyisobutylene sealant, or combinations thereof.

21. The door assembly according to claim 15, further comprising an edge seal element provided between the confronting inner surfaces of the window panes and adjacent the spacer, the edge seal element comprising air gaps, a gas, a desiccant, or combinations thereof within the edge seal element.

22. The door assembly according to claim 21 further comprising a seal provided between the peripheral frame and an inner surface of the door panel.

* * * * *